US007640924B2

(12) United States Patent
Cherepanov

(10) Patent No.: US 7,640,924 B2
(45) Date of Patent: Jan. 5, 2010

(54) MECHANISM FOR FEEDING BALL BULLETS FROM A BIN TO A HOLDER

(75) Inventor: Valery Leonidovich Cherepanov, Izhevsk (RU)

(73) Assignee: Federalnoe Gosudarstvennoe Unitarnoe Predpriyatie "Izhevsky Mekhanichesky Zavod", Izhevsk (RU)

( * ) Notice: Subject to any disclaimer, the term of this patent is extended or adjusted under 35 U.S.C. 154(b) by 333 days.

(21) Appl. No.: 11/516,332

(22) Filed: Sep. 6, 2006

(65) Prior Publication Data

US 2007/0175464 A1 Aug. 2, 2007

(30) Foreign Application Priority Data

Jan. 31, 2006 (RU) ..... 2006102830

(51) Int. Cl.
*F41B 11/02* (2006.01)

(52) U.S. Cl. ..... 124/51.1

(58) Field of Classification Search ..... 124/51.1, 124/52

See application file for complete search history.

(56) References Cited

U.S. PATENT DOCUMENTS 307,275 A * 10/1884 Edmondson ..... 198/659
1,413,694 A * 4/1922 Vollmer ..... 89/33.17
2,628,376 A * 2/1953 Scribner ..... 15/3.14
2,951,422 A * 9/1960 Bobkowski ..... 89/33.1
4,872,547 A * 10/1989 Helland ..... 198/659

FOREIGN PATENT DOCUMENTS

JP 4-18237 1/1992
JP 6-74691 3/1994

OTHER PUBLICATIONS

Computer-Generated English Translation and Patent Abstracts of Japan of JP 6-74691 dated Mar. 18, 1994.
Patent Abstracts of Japan of JP 4-18237 dated Jan. 22, 1992.

* cited by examiner

*Primary Examiner*—John Ricci
(74) *Attorney, Agent, or Firm*—Ladas and Parry LLP

(57) ABSTRACT

A feeding mechanism for ball bullets from a bin to a holder. The mechanism contains a bin 1 and additional reservoir 2 which in a lower part communicate. A vibrator 3 is placed in the lower part of the bin 1 and the additional reservoir 2. The vibrator 3 is formed of two plates 4 and 5 of L-shape that oscillate on the axis 6 due to spring 7 and cam 8, which is rotated by the electric drive 9. A feeding screw mechanism is disposed in the lower part of the bin 1 and the additional reservoir 2, the mechanism comprising a screw 10 with a helical spring. The base 12 is connected to cam 8 through a friction coupling 13. The cam 8 gains rotation from the electric drive 9 through the gearing 14. The bin 1 with additional reservoir 2 communicates with the holder 16 through the channel 15.

9 Claims, 2 Drawing Sheets

MECHANISM FOR FEEDING BALL BULLETS FROM A BIN TO A HOLDER

FIELD OF THE INVENTION

The invention relates to a pneumatic weapon, in particular, to mechanisms for feeding ball bullets from the bin to a holder.

BACKGROUND ART

An automatic gun, for shooting plastic balls is known according to the Japanese patent No. 4-18237, F41C 3/06. The gun comprises a holder magazine, a bin, a feeding mechanism, and a drive operated manually by the user. When the user manually pulls an actuator element, the feeding mechanism rotates, and balls placed between teeth of toothed feeding mechanism pass through a channel of the holder magazine to an output opening.

A drawback of the device is that manual feeding of the holder magazine reduces performance of the gun. The rigid walls of the bin contribute to formation of congestion of the bullets, which prevents feeding of the bullets to the barrel of the gun. The rigid feeding system can result in blocking the mechanism, that is also a drawback of the known device.

A ball feeding mechanism for toy guns is known according to Japanese patent No. 06074691, application 04227495, cl. F41B 11/02. The feeding mechanism comprises a bin and a screw feeder (worm) with an electric motor below the bin. The screw feeds balls from the bin through a lead-in section to a forcing section. The balls are then fed by means of compressed air to a flexible tube (holder) to the gun. Compressed air maintains balls in the flexible tube and escapes through openings in the tube.

The rigidity of the bin walls and absence of additional devices to eliminate congestion of ball bullets at the bin outlet can result in a shut-down of the gun operation and reduce its reliability. The gun has an air source (additional propellant) that feeds ball bullets to the gun and complicates the gun structure. This is a drawback.

SUMMARY OF THE INVENTION

It is an object of the present invention to create an article with increased operation reliability with simultaneous simplification of its structure.

This object is achieved by means of a feeding mechanism for ball bullets from the bin to the holder comprising a screw with electric drive, a bin and a holder. The screw comprises a helical compression spring.

Preferably, the screw comprises a cylindrical base, and a compression spring is fixed on it at an end distal to the holder.

The bin can be formed with a first and an additional reservoir, with both reservoirs being provided with a common vibrator.

It is preferable that both reservoirs of the bin interconnect.

A gap between spring turns should range from 1.2-1.5 of the ball diameter.

The vibrator can be configured for operation with the feeding mechanism drive.

The vibrator movement is preferably operated from the drive through a cam.

Preferably the vibrator is disposed in the lower part of the bin, and is formed of two plates, joined together to form an L-shape fixed to the axis and elastically pressed against the cam.

The feeding mechanism comprising the compression spring provides constant urging of the ball bullets to an indent opposite the channel so as to ensure stable initial speed of the ball bullet when the gun is shot. This feeding mechanism makes it possible to increase operation reliability since a vibrator is disposed in the lower parts of both reservoirs of the bin, thereby preventing congestion at the inlet of the holding part of the magazine.

The additional reservoir in the bin assists in also preventing ball congestion by directing ball bullets accumulated at the holder entry to the additional reservoir of the bin by operation of the electric drive.

BRIEF DESCRIPTION OF THE DRAWINGS

The invention is illustrated by drawing as follows.

DETAILED DESCRIPTION OF THE INVENTION

Figure 1:
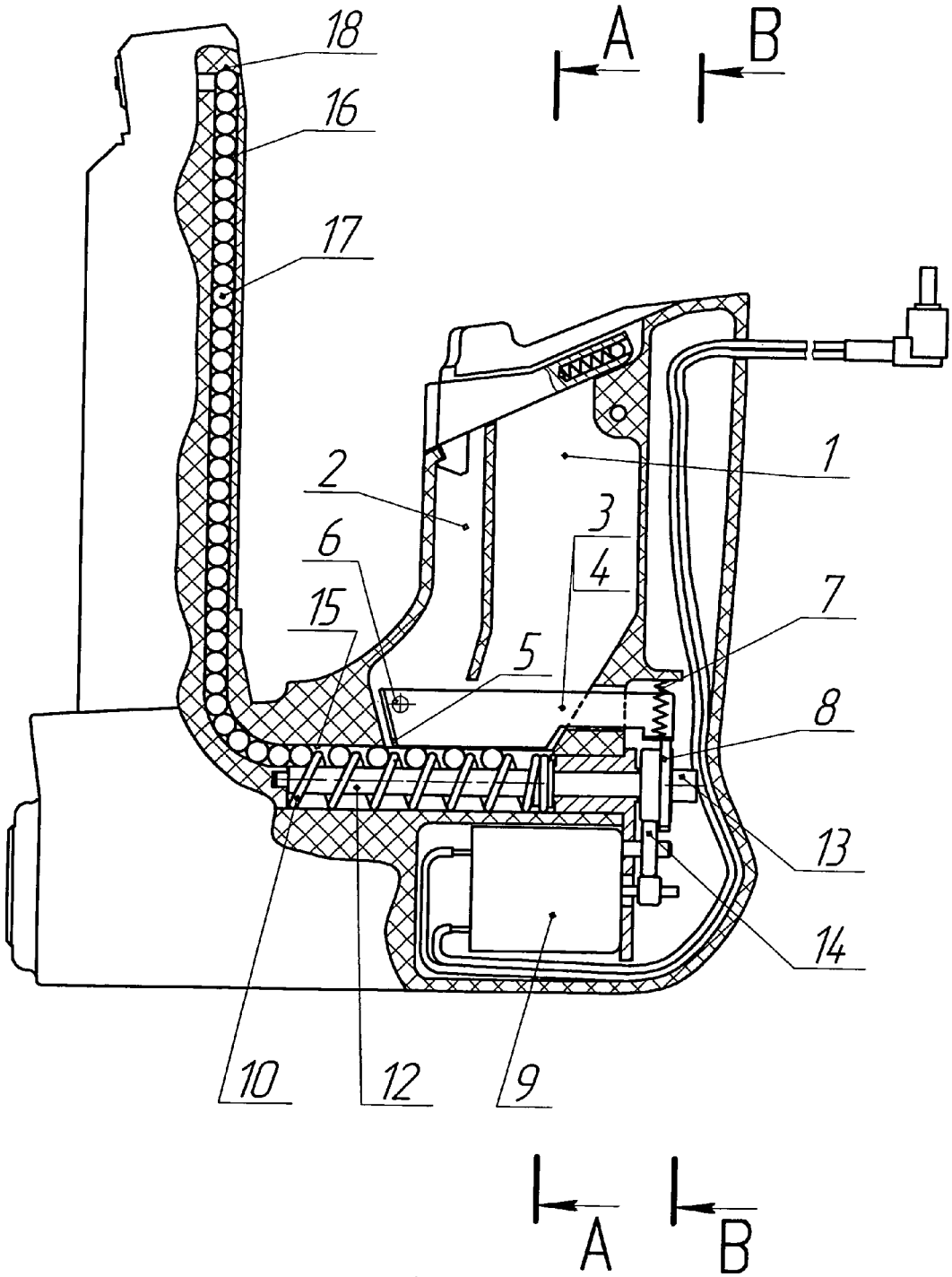
FIG. 1 shows a general view of the device.
Figure 2:
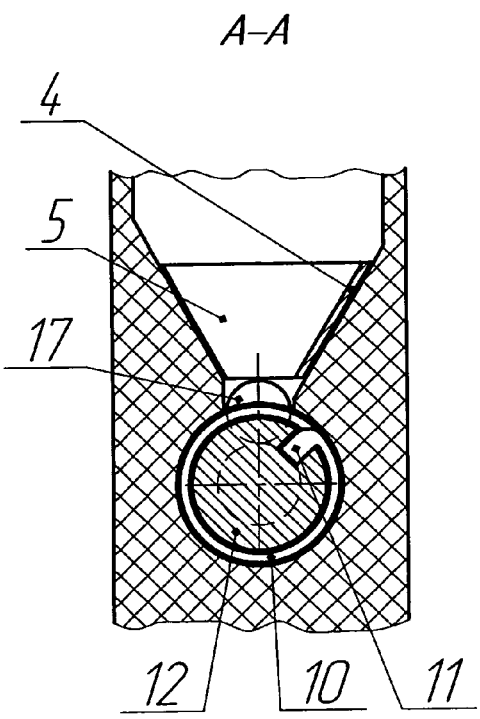
FIG. 2 shows a cross-section A-A of FIG. 1.
Figure 3:
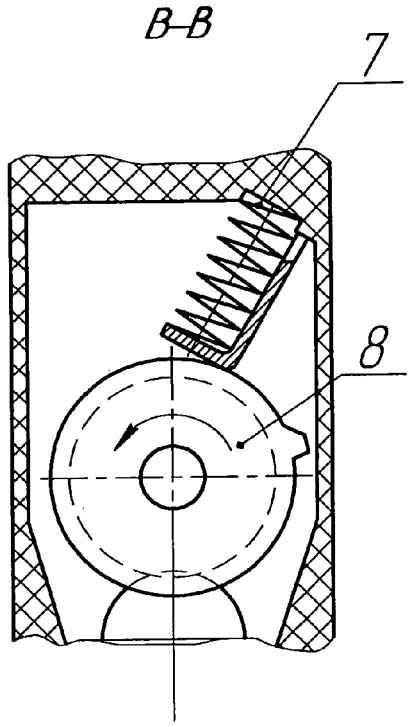
FIG. 3 shows a cross-section B-B of FIG. 1.

The ball bullets feeding mechanism comprises a bin 1 and an additional reservoir 2 which, in a lower part, communicate with each other therebetween. Vibrator 3 and additional reservoir 2 are disposed in the lower part of the bin 1. The vibrator 3 comprises two plates 4 and 5 formed in L-shape and oscillating on axis 6 by spring 7 and cam 8, which is rotated by the electric drive 9. A feeding screw mechanism is provided in the lower part of bin 1 and additional reservoir 2, the screw mechanism comprising a screw 10 having a helical compression spring which is connected to a cylindrical base 12 by bent end 11 distal to the holder. Thus the base 12 is connected to a cam 8 through a friction coupling 13. The cam 8 is rotationally driven from the electric drive 9 through a gearing 14. The bin 1 with the additional reservoir 2 communicates with a holder 16 through channel 15.

The ball bullets feeding mechanism from the bin to the holder operates as follows:

Ball bullets 17 are fed in the bin 1 and the electric drive 9 is actuated. The electric drive 9 rotates cam 8 through the gearing 14. It also rotates the screw 10 through the friction coupling 13 and the base 12. The ball bullets 17, under action of gravity, descend from the bin 1 to the base 12 of the feeding screw mechanism and are urged by the screw spiral of the screw 10, through the channel 15, to the holder 16. The rotating cam 8 activates the vibrator 3 elastically pressed to the cam 8 by spring 7. The plates 4 and 5 swinging around an axis 6, stirs ball bullets 17 preventing congestion.

When holder 16 is filled by the ball bullets 17, the screw 10—comprising a compression spring with a gap between turns equal to 1.2-1.5 diameters of the ball diameter—is compressed to provide elastic compression of ball bullets 17 in the holder and the first ball to the indent 18. The friction coupling 13 defines the predetermined compression force.

When the holder 15 is filled, rotation of the screw 10 ceases. The gun is ready to shoot.

Pressing a trigger (not shown in the drawing) causes ejection of the ball bullets 17 under action of compressed gas from the barrel of the gun. At the same time, the electric drive 9 fills the holder 16 with balls. The electric drive may be controlled by an electronic device.

What is claimed is:

1. A feeding mechanism for ball bullets comprising:

a screw mechanism;

a drive of the screw mechanism with a friction coupling;

a bin;

a holder; and a vibrator;

said screw mechanism comprising a cylindrical base, a spiral compression spring comprising first and second ends, said compression spring being attached to said cylindrical base by the second spring end which is distal from the holder;

said drive of the screw mechanism being connected to the cylindrical base through said friction coupling;

said bin having an additional container for balls, the bin and the additional container being interconnected;

wherein said bin and said additional container for balls are provided with said vibrator.

2. The mechanism according to claim 1, wherein the spring has turns with a gap between the turns of the spring being in the range from 1.2 to 1.5 of a diameter of the balls.

3. The mechanism according to claim 1, further comprising a cam attached to said drive of the screw mechanism with the friction coupling, said cam being configured to activate the vibrator.

4. The mechanism according to claim 3, wherein said vibrator is formed of two plates joined in an L-shaped combination rotatable around an axis and pressed against the cam.

5. An apparatus for feeding balls to a gun comprising:

(1) a bin for the balls comprising a first reservoir and an additional reservoir, the first and additional reservoirs communicating with each other at a lower part of the bin;

(2) vibrator means disposed in the lower part of the bin for shaking the balls in the lower part of the bin to inhibit congestion of the balls in the lower part;

(3) a screw mechanism for urging balls from the lower part to a holder for the balls from which the balls may be discharged to the gun, said mechanism comprising a cylindrical base and a spiral compression spring attached to the cylindrical base at a first end of the spring that is distal from the holder; and (4) a drive for the screw mechanism comprising a friction coupling.

6. The apparatus according to claim 5, wherein the spring has turns with a gap between the turns of the spring being in the range from 1.2 to 1.5 of a diameter of the balls.

7. The apparatus according to claim 5, further comprising a cam attached to said drive of the screw mechanism with the friction coupling, said cam being configured to activate the vibrator.

8. The apparatus according to claim 5, wherein said vibrator is formed of two plates joined in an L-shaped combination rotatable around an axis and pressed against the cam.

9. The apparatus as claimed in claim 5, further comprising a plurality of balls, said holder being dimensioned such that the balls pass through the holder in single file.

* * * * *